US005267452A

United States Patent [19]

Zinsmeyer et al.

[11] Patent Number: 5,267,452

[45] Date of Patent: Dec. 7, 1993

[54] BACK PRESSURE VALVE

[75] Inventors: Thomas M. Zinsmeyer, Pennellville; Vishnu M. Sishtla, Cicero, both of N.Y.

[73] Assignee: Carrier Corporation, Syracuse, N.Y.

[21] Appl. No.: 8,438

[22] Filed: Jan. 25, 1993

Related U.S. Application Data

[63] Continuation-in-part of Ser. No. 815,776, Jan. 2, 1992, abandoned.

[51] Int. Cl.[5] ..... F25B 31/02; F16K 17/04

[52] U.S. Cl. ..... 62/505; 137/538; 138/45; 138/46

[58] Field of Search ..... 62/196.3, 505; 137/538, 137/543.15; 138/45, 46

[56] References Cited

U.S. PATENT DOCUMENTS

| | | | |
|---|---|---|---|
| 1,798,536 | 3/1931 | Hofmann | 137/538 |
| 2,212,833 | 8/1940 | Huber | 137/538 |
| 2,247,449 | 7/1941 | Neeson | 62/196.3 |
| 3,146,605 | 9/1964 | Rachfal et al. | 62/505 |
| 3,158,009 | 11/1964 | Rayner | 62/505 |
| 3,163,999 | 1/1965 | Ditzler et al. | 62/505 |
| 3,204,664 | 9/1965 | Gorchev et al. | 138/46 |
| 3,877,489 | 4/1975 | Louie et al. | 138/46 |
| 4,383,550 | 5/1983 | Sotokazu | 138/46 |
| 4,770,212 | 9/1988 | Wienck | 138/45 |
| 4,781,161 | 11/1988 | Sausner et al. | 138/45 |

FOREIGN PATENT DOCUMENTS

| | | | |
|---|---|---|---|
| 947655 | 2/1956 | Fed. Rep. of Germany | 137/538 |
| 1099814 | 2/1961 | Fed. Rep. of Germany | 137/538 |
| 74260 | 11/1960 | France | 138/45 |
| 15155 | 1/1982 | Japan | 138/45 |

*Primary Examiner*—John Rivell
*Assistant Examiner*—L. R. Leo

[57] ABSTRACT

A shaft-mounted piston is reciprocally disposed on the axis of a valve inlet opening such that increased pressure from within the motor casing of a centrifugal compressor causes the piston to move in the direction of the refrigerant flow, against a biasing means, to increase the flow of refrigerant through the opening, and to thereby regulate the pressure drop across said valve to a predetermined level. The shaft has an extended portion projecting through the piston toward the motor casing such that when the compressor is shut down and the pressure is thus greater in the valve than in the motor casing, the piston can move out of the inlet opening to the extended portion of the shaft to thereby allow the unrestricted flow of refrigerant into the motor casing.

14 Claims, 6 Drawing Sheets

BACK PRESSURE VALVE

BACKGROUND OF THE INVENTION

This is a Continuation-in-Part application of U.S. patent application Ser. No. 07/815,776, filed Jan. 2, 1992 now abandoned.

This invention related generally to refrigeration systems and, more particularly, to the control of refrigerant flow in a centrifugal compressor.

In large chiller systems, a centrifugal compressor is commonly driven by an electric motor that generates a significant amount of heat. It is therefore the usual practice to cool the motor by introducing liquid refrigerant into the motor casing, with the resultant refrigerant gas then being returned to the system by way of a return line passing to the evaporator or cooler. Because of the need to maintain a relatively low pressure within the motor casing in order to maximize the cooling effect, while at the same time providing a pressure high enough to thereby prevent the migration of oil into the motor casing from the adjacent transmission, it is common practice to place a back-pressure valve in the refrigerant return line, its function being to maintain a predetermined pressure drop across the return line and to thereby maintain a predetermined level within the motor casing.

One form of such a valve that has been used is a spring biased flapper valve which tends to open against the bias as the pressure differential increased. While the approach has been satisfactory for lower pressure refrigerants such as R-11, it has been found to be unsatisfactory in higher pressure systems such as one with R-22 refrigerant. That is, with R-22, it has been found that such a flapper valve does not provide the required responsiveness to maintain the desired pressure drop across the valve.

Other types of commercial pressure regulators are available to perform the function in high pressure systems. However, they tend to be large, expensive and complicated.

Existing back-pressure valves are designed to maintain a given pressure drop across the valve when the refrigerant is flowing from the motor casing, with the valve being in the most open position when the flow volume is the greatest and being in a closed or near closed position when the volume flow is at a minimum. Accordingly, in a reverse flow condition, that is with the refrigerant flowing from the cooler back into the motor casing, the back-pressure valve will be in a generally closed down position. This can be a problem under shut-down conditions.

During normal operation, the motor casing is maintained at a pressure level above that of the adjacent transmission. However, when the compressor is shut down, the refrigerant tends to flow in the reverse direction so as to equalize the pressure in the system. The transmission therefore undergoes a rapid increase in pressure, but the motor, which is effectively isolated from the rest of the system by the closed back-pressure valve, remains at a relatively low pressure. As a result, the differential pressure forces the oil from the transmission into the motor casing, with the oil then being subsequently pumped to the evaporator when normal operation resumes. This represents a loss of oil from the system, will result in efficiency losses, and may result in damage to the system components.

It is therefore an object of the present invention to provide an improved back-pressure valve for a centrifugal compressor.

Another object of the present invention is the provision in a high pressure centrifugal compressor for a back-pressure valve which is simple, effective, and economical in use.

Yet another object of the present invention is the provision in a centrifugal compressor for preventing loss of oil during shut-down conditions.

Another object of the present invention is to provide a minimum flow area at zero pressure differential, and a maximum flow area at high positive pressure and at all negative pressures.

Still another object of the present invention is the provision for a back-pressure valve which allows the pressure in the motor casing to rise during shut-down conditions.

These objects and other features and advantages become more readily apparent upon reference to the following description when taken in conjunction with the appended drawings.

SUMMARY OF THE INVENTION

Briefly, in accordance with aspect of the invention, a piston is reciprocally mounted within a cylindrical body and is biased toward a closed position against an inlet opening closest to the motor casing. As the pressure in the motor casing increases, the piston tends to move against the bias away from the inlet opening to thereby increase the flow of refrigerant and to thereby decrease the pressure differential. In this way, the valve tends to maintain a constant pressure differential across the inlet opening.

In accordance with another aspect of the invention, the piston is tapered in form, with the end further from the motor casing being of a larger diameter than the other end thereof. In the relatively closed position, the larger diameter end is near or within the inlet opening and the other end thereof projects through the inlet opening, toward the motor casing. In the relatively open position, the entire piston moves into the cylindrical body to thereby increase the flow of refrigerant along the tapered surface of the piston.

By another aspect of the invention, the piston is mounted on a shaft that is reciprocally mounted, in a cantilevered manner, from a discharge and of the cylindrical body. A compression spring surrounds the rod and is held in compression by a retainer element rigidly secured to the shaft. The piston has a cavity formed in its larger diameter end for receiving the retainer element therein, in axially abutting relationship.

By yet another aspect of the invention, the shaft is extended through and beyond the inlet opening such that it extends well beyond the system small diameter end. Thus, during coast down and shut-down conditions, when the pressure in the cooler is substantially greater than that in the motor casing, the piston is moved along the shaft to a point outside of the inlet opening to thereby allow the relatively unrestricted flow of refrigerant into the motor casing to thereby equalize the pressure in the system. A retainer ring is secured near the end of the shaft to limit the movement of the piston on the shaft.

By yet another aspect of the invention, the valve is mounted or positioned such that the shaft is oriented vertically with the piston resting on the retainer. Thus, after coast down and shut-down conditions, when the pressure in the cooler is equal to that in the motor, the piston falls back into a position of minimum flow area.

By a slight variation of the invention, the valve can be positioned in a vertical or a horizontal fashion and yet be allowed to come to a position of minimum flow area when the differential pressure between the motor and the cooler is zero. This is accomplished by adding a spring between the piston and the top of the shaft. The spring is designed such that the free length is equal to the distance between the top of the shaft and the piston in the minimum area position. Thus, after coast down and shut-down conditions, the spring of low stiffness will push back the piston to the position of minimum flow area. Further, this additional spring will be of low stiffness such that the valve will open even with a small negative pressure differential. A positive pressure differential will move the piston against the spring between the piston and the valve body.

In the drawings is hereinafter described, a preferred embodiment is depicted; however, various modifications and other constructions can be made thereto without departing from the true spirit and scope of the invention.

DESCRIPTION OF THE PREFERRED EMBODIMENT

Figure 1:
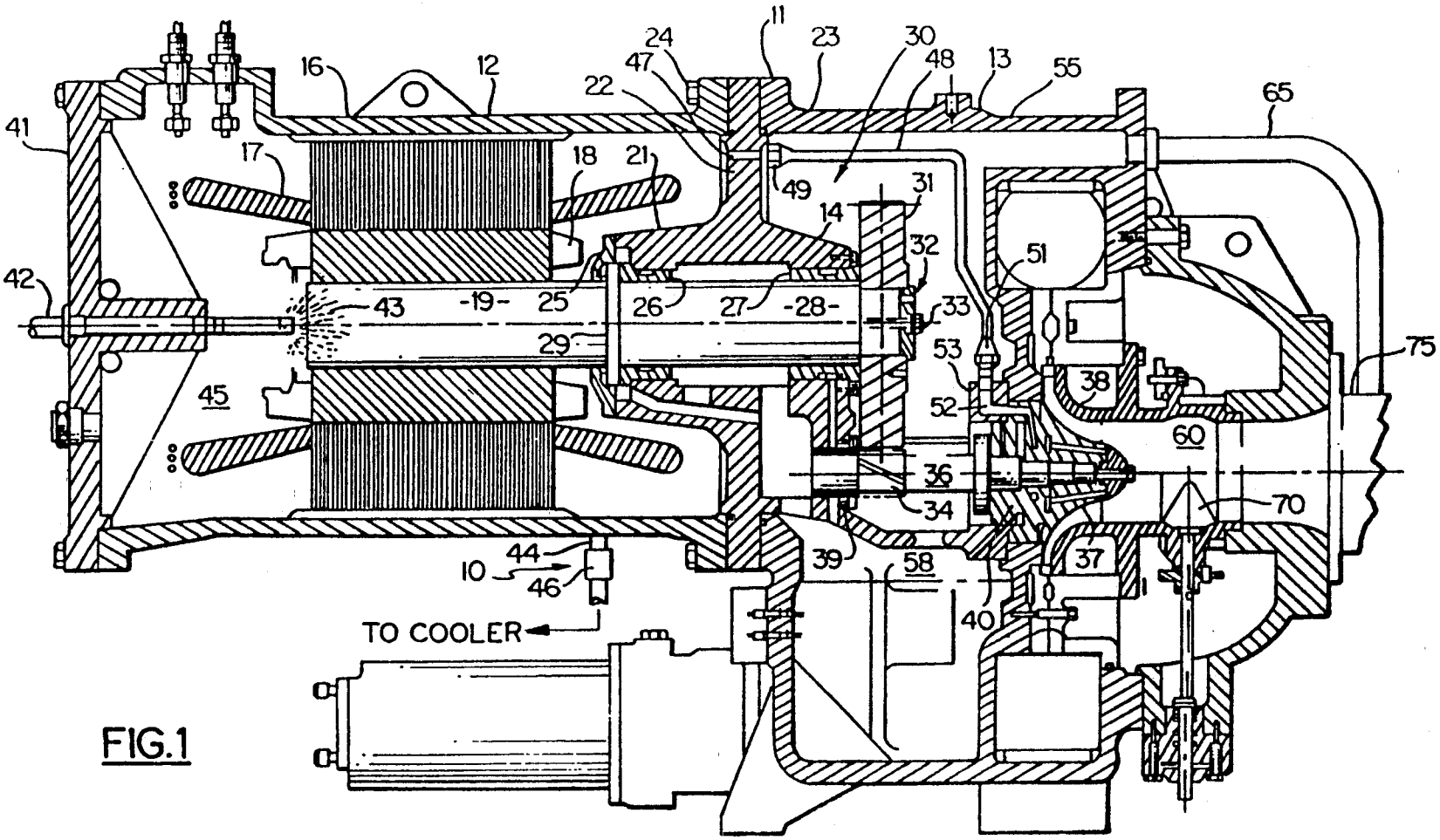
FIG. 1 is a longitudinal cross sectional view of a centrifugal compressor having the back-pressure valve of the present invention incorporated therein.

Referring now to FIG. 1, the invention is shown generally at 10 as embodied in a centrifugal compressor system 11 having an electric motor 12 at its one end and a centrifugal compressor 13 at its other end, with the two being interconnected by a transmission 14.

The motor 12 includes an outer casing 16 with a stator coil 17 disposed around its inner circumference. The rotor 18 is then rotatably disposed within the stator winding 17 by way of a rotor shaft 19 which is overhung from, and supported by, the transmission 14. The transmission 14 includes a transmission case 21 having a radially extending annular flange 22 which is secured between the motor casing 16 and the compressor casing 23 by a plurality of bolts 24, with the transmission case 21 and the compressor casing partially defining a transmission chamber 30.

Rotatably mounted within the transmission case 21, by way of a pair of axially spaced bearings 26 and 27 is a transmission shaft 28 which is preferably integrally formed as an extension of the motor shaft 19. The collar 29, which is an integral part of the shaft or attached by shrink fitting, is provided to transmit the thrust forces from the shaft 28 to the thrust bearing portion of the bearing 26. The end of shaft 28 extends beyond the transmission case 21 where a drive gear 31 is attached thereto by way of a retaining plate 32 and a bolt 33. The drive gear 31 engages a driven gear 34 which in turn drives a high speed shaft 36 for directly driving the compressor impeller 37. The high speed shaft 36 is supported by journal bearings 39 and 40.

In order to reduce windage losses in the transmission 14 and to prevent oil losses from the transmission chamber 30, the transmission chamber 30 is vented to the lowest pressure in the system (i.e., compressor suction pressure) by way of passage 55, tube 65, and compressor suction pipe 75.

In order to cool the motor 12, liquid refrigerant is introduced from the condenser (not shown) into one end 41 of the motor 12 by way of an injection port 42. Liquid refrigerant, which is represented by the numeral 43, enters the motor chamber 45 and boils to cool the motor 12, with the refrigerant gas then returning to the cooler by way of a motor cooling return line 44. A back-pressure valve 46 is included in the line 44 in order to maintain a predetermined pressure differential (i.e., about 5–6 psi) between the motor chamber 45 and the cooler, which typically operates at about 80 psia. Compressor suction pipe 75, at the point where transmission vent tube 65 is connected, is typically at a pressure 1–2 psi less than the cooler. This establishes a transmission pressure of about 78–79 psia. Thus, during normal operation, the pressure in the motor chamber is maintained at 85–86 psia, which is about 6–8 psia or 7.6–10.3% above that in the transmission chamber 30.

Figure 2:
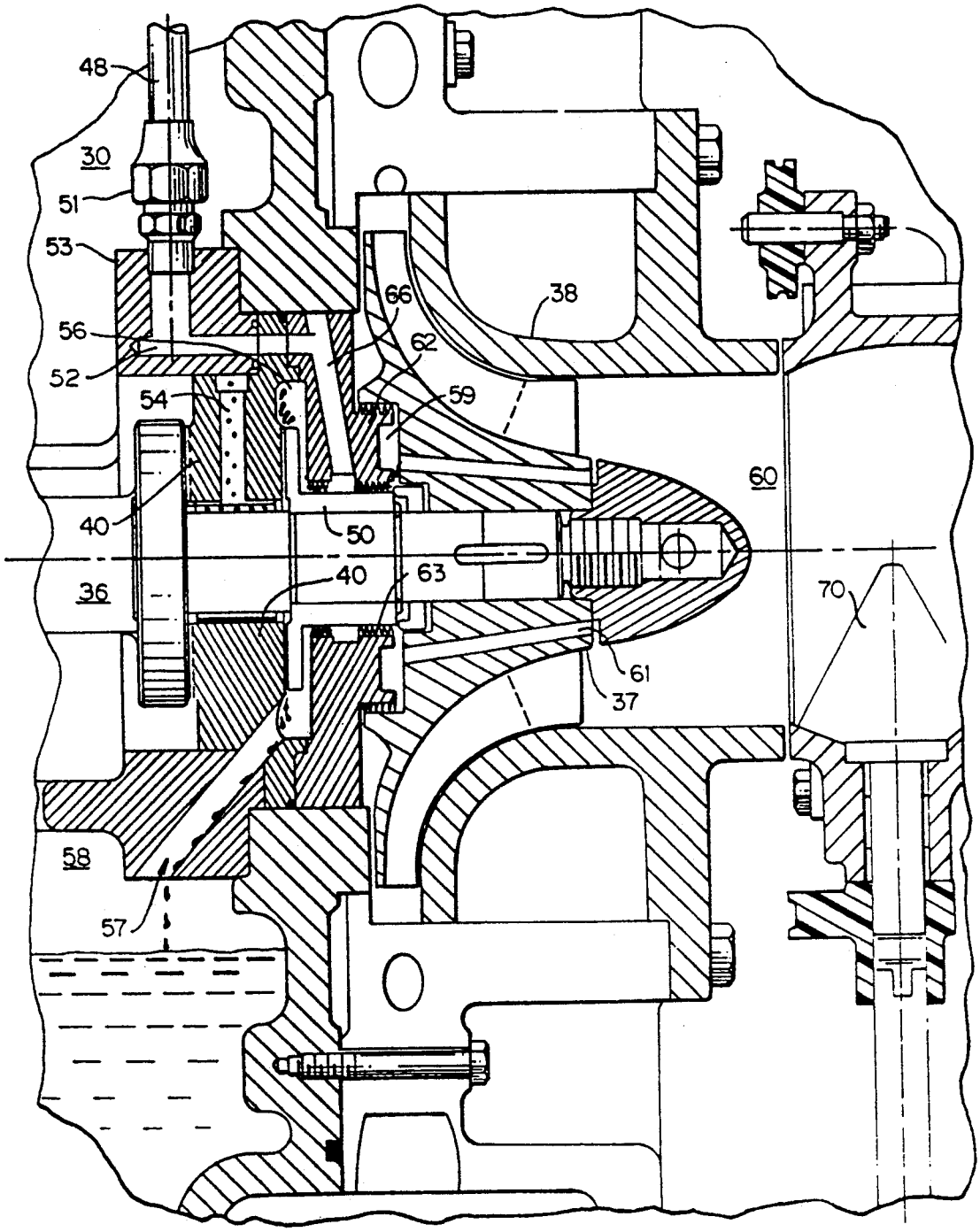
FIG. 2 is an enlarged partial view thereof.

Also, fluidly communicating with the motor chamber 45 is an opening 47 in the annular flange 22 of the transmission case 21. A line 48 is attached at its one end to the opening 47 by way of a standard coupling member 49. At the other end of the line 48 is a coupling member 51 which fluidly connects the line 48 to a passage 52 formed in flange member 53 as shown in FIG. 1 and as can be better seen in FIG. 2. The bearing 40 functions as both a journal bearing to maintain the radial position of the shaft 36 and as a thrust bearing to maintain the axial position thereof. An oil feed passage 54 is provided as a conduit for oil flowing radially inwardly to the bearing surfaces, and an oil slinger 50 is provided to sling the oil radially outward from the shaft 36. An annular cavity 56 then functions to receive the oil which is slung off from the bearing 40 and to facilitate the drainage of oil through a passage 57 and back to the sump 58.

In order to provide a counteraction to the aerodynamic thrust that is developed by the impeller 37, a "balance piston" is provided by way of a low pressure cavity 59 behind the impeller wheel 37. A passage 61 is provided in the impeller 37 in order to maintain the pressure in the cavity 59 at the same low pressure as the compressor suction indicated generally by the numeral 60. This pressure (downstream of the guide vanes 70) typically varies from around 77 psia at full load, down to 40 psia at 10% load. Since the pressure in the transmission casing is higher (i.e., equal to the compressor suction pressure upstream of the inlet guide vanes 70, or about 78–79 psia) than that in the cavity 59, and especially at part load operation, a labyrinth seal 62 with its associated teeth 63 is provided between the bearing 40 and the impeller 37 to seal that area against the flow of oil from the transmission into the balance piston 59.

The labyrinth seal 62 is pressurized with the refrigerant vapor in the motor chamber 45, which vapor passes through the line 48, the passage 52, and a passage 66 in the labyrinth seal 62. Thus, the labyrinth seal 62 is pressurized at the motor casing pressure of 85–86 psia, which is 6–8 psi above the transmission pressure during normal operation.

Considering now what occurs when the compressor is shut down, the purpose and function of the present invention will be more clearly understood. When the motor 12 is turned off, the impeller 37 stops but, as a precautionary measure, the oil pump continues to run for another 30 seconds or so. Since the discharge pressure at this time is approximately 200 psi, and the compressor suction pressure is around 77 psi, the refrigerant immediately beings to flow in the reverse direction and continues that flow until the pressure within the system is equalized at around 115–120 psi. Because of the vent tube 65, the transmission chamber 30 rises to that pressure level very quickly. However, unless the back-pressure valve 46 allows for the relatively free flow of refrigerant into the motor casing 16, that casing remains relatively isolated from the system at a pressure level of about 85 psi. Because of this significant pressure differential, oil is then forced to flow from the transmission chamber 30 through the bearings 27 and 26, and through a low speed shaft labyrinth 25 just downstream of the collar 29 to enter the motor casing 16. The oil also tends to flow from the high speed labyrinth seal 62 through the passage 66, the passage 52, and the line 48 to enter the motor casing in this manner. As a result, a significant supply of oil is removed from the system and then enters the cooler by way of the conduit 44 when the compressor is again turned on. The present invention, therefore, has for one of its purposes, that of preventing the flow of oil into the motor casing 16.

Figure 4:
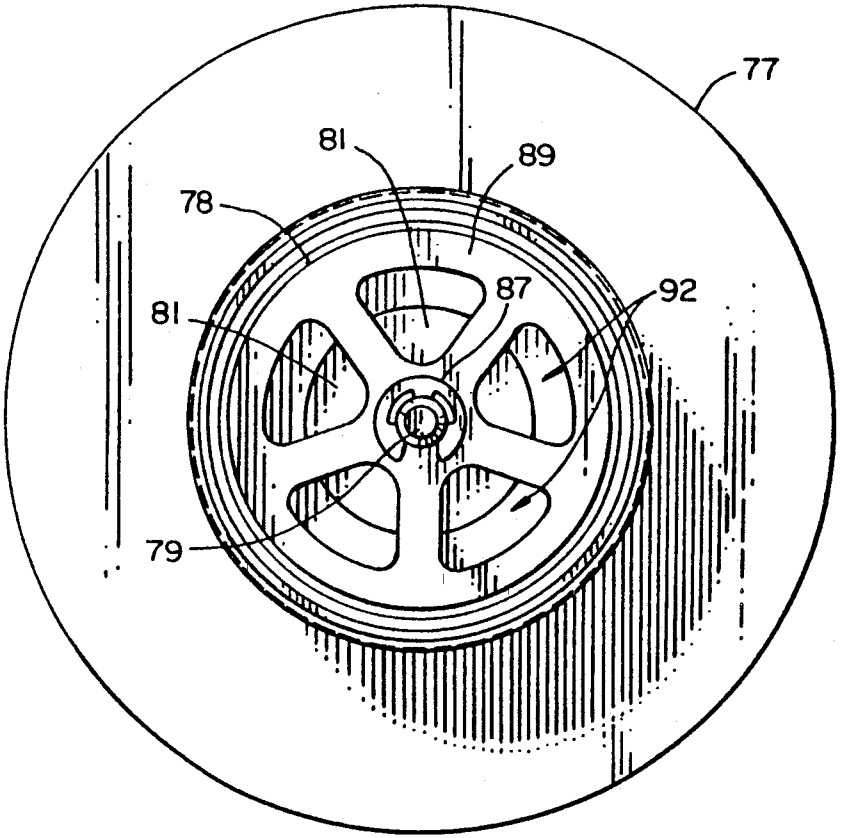
FIG. 4 is a top end view thereof.
Figure 3:
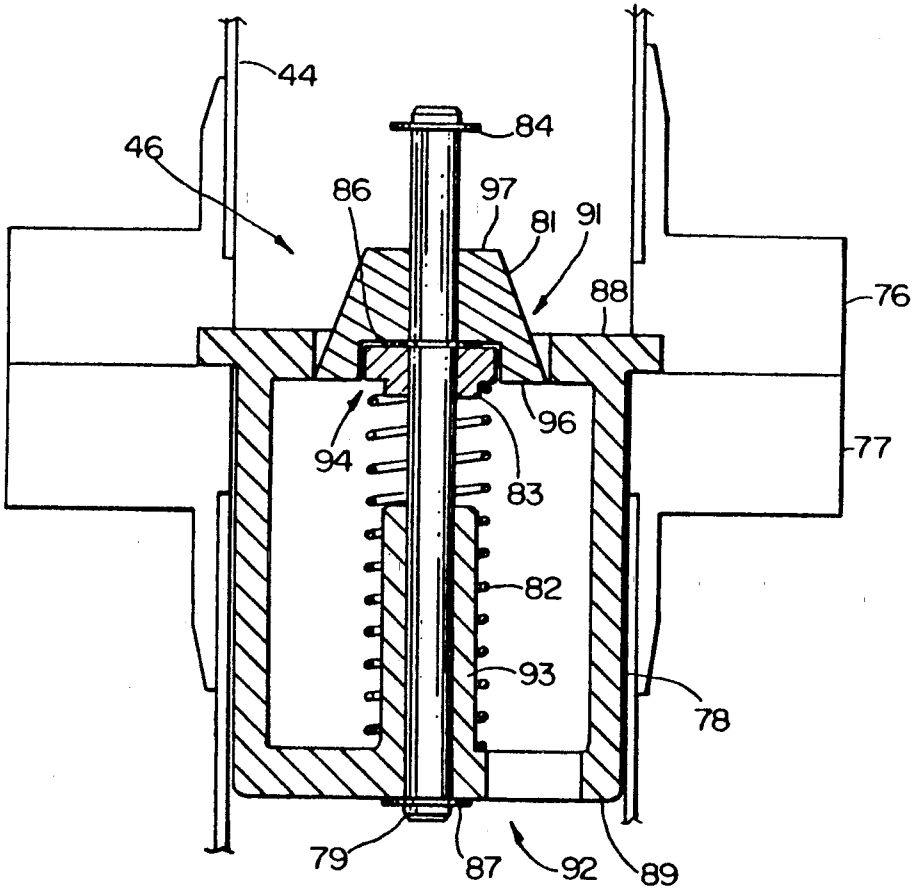
FIG. 3 is a longitudinal sectional view of the back-pressure valve of the present invention.

Referring to FIGS. 3 and 4, the back-pressure valve 46 of the present invention is shown in its installed position within the motor cooling return line 44 by way of a pair of flanges 76 and 77 which are secured by way of brazing or the like. It is installed such that its axis is oriented vertically so that gravity can act on the piston element thereof as will be described hereinafter. The valve 46 comprises a valve body 78, a shaft 79, a tapered plug or piston 81, a compression spring 82, and a retainer 83. There are also three retaining rings 84, 86, and 87 which are attached to the shaft 79 in a manner to be described more fully hereinafter.

The valve body 78 is cylindrical in form and has an inlet end 88 and a discharge end 89, with the inlet 88 having an inlet opening 91 and the discharge end 89 having a plurality of discharge opening 92. During normal operation, the refrigerant flows into the inlet opening 91, through the valve body 78 and out the discharge openings 92.

Secured within a cylindrical sleeve 93 and projecting axially into the valve body 78 from the discharge end 89 is the shaft 79, which is free to reciprocate within the sleeve 93 but is limited in one direction by the retaining ring 87, which is snapped into a groove in the shaft 79 and engages the discharge end 89.

The compression spring 82 is disposed over the sleeve 93 and is maintained in a compressed state by the retainer 83, which is slideably disposed on the shaft 79 but secured on its one end by the retaining ring 86 which fits into a groove on the shaft 79. As will be seen, the retainer 83 is cylindrical in form and fits into a cylindrical cavity 94 at one end of the tapered plug 81.

The tapered plug 81 has a larger diameter at its one end 96 closer to the discharge end 89, and a smaller diameter at its other end 97. The outer diameter of the plug one end 96 is slightly smaller than the diameter of the inlet opening such that the plug 81, which is slideably mounted on the shaft 79, is free to move out of the inlet opening 91 and come to rest against the retaining ring 84 to thereby allow refrigerant flow to occur in the opposite direction during shut-down conditions as will be described hereinafter. Similarly, during normal operation with relatively small pressure differentials, the clearance between the plug 97 and the sides of the inlet opening 91 allows for a small amount of refrigerant to flow through the inlet opening 91 and out the discharge openings 92. But when the pressure differential increases, the plug 97 engages the retaining ring 86 and moves the entire shaft 79 against the bias of the compression spring 93 to thereby increase the space between the plug 97 and the edge surrounding the inlet opening 91.

Figure 5:
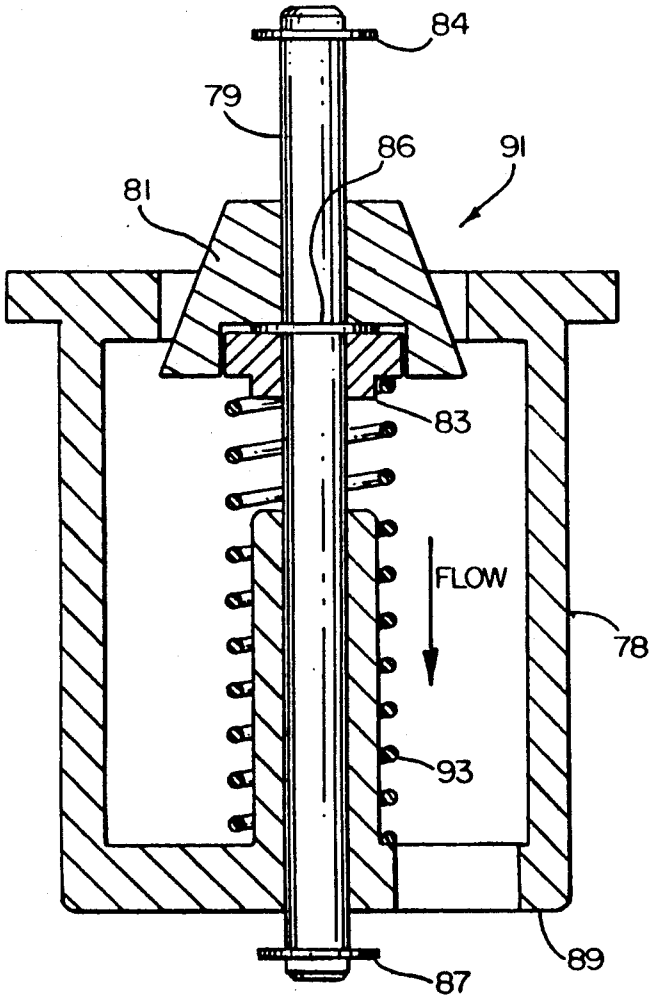
FIG. 5 is a longitudinal sectional view thereof, showing the refrigerant flow during normal operating conditions.

Referring now to FIG. 5, the back-pressure valve is shown in an operational condition wherein the pressure within the motor casing has increased to a point where the tapered plug 81 is moved against the retaining ring 86 to overcome the bias of the spring 93 and to thereby move the shaft 79 to the point where the retaining ring 87 is moved away from the discharge end 89 as shown. In this position, the clearance between the tapered plug 81 and the structure surrounding the inlet opening 91 is increased to thereby allow an increased flow of refrigerant. This increased flow will in turn reduce the pressure differential to the predetermined level of 5–6 psi. In this way, the valve 46 functions to maintain that pressure differential during normal operation.

Figure 6:
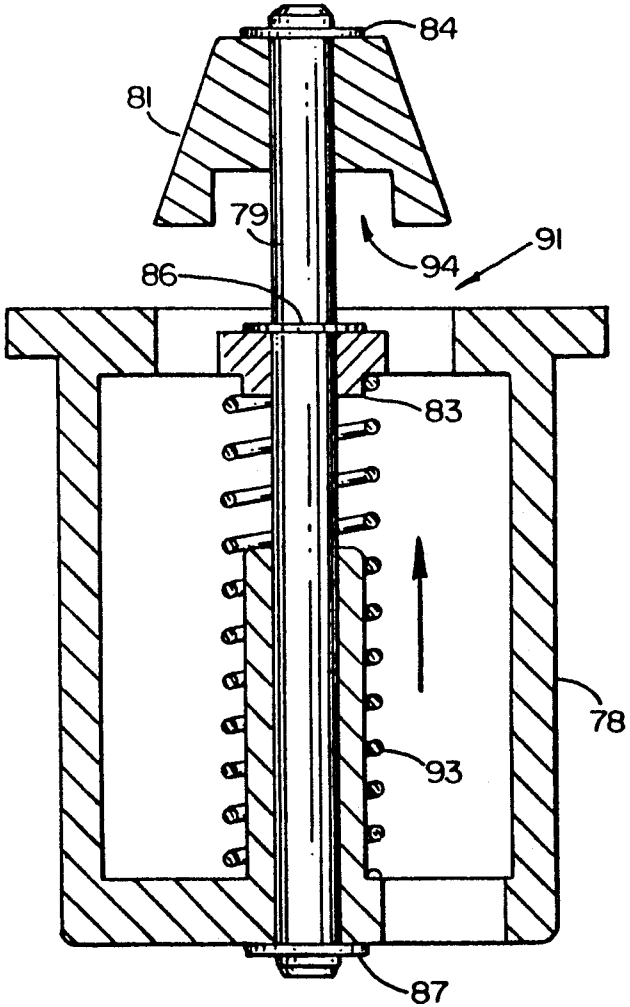
FIG. 6 is a longitudinal sectional view thereof, showing the flow of refrigerant during shut-down conditions.

When the unit is shut down as described hereinabove, the flow of refrigerant is reversed within the system, the pressure in the cooler will rise to around 115 psi, while the pressure in the motor casing 16 will remain at around 85 psi. Because of this significant pressure differential, the tapered plug 81 will be quickly moved to the position as shown in FIG. 6, which will then allow the relatively unrestricted flow of refrigerant through the inlet opening 91 and into the motor casing 16. The pressure in the motor casing 16 will therefore rise to about the same level of 115 psi, which is the same pressure as exists in the transmission chamber 30. Thus, the problem of oil being forced into the motor casing 16 is thereby avoided.

As mentioned hereinabove the valve 46 is installed with its shaft being oriented in a vertical position with the retaining ring at the top. Thus, after shut down has occurred and pressures are equalized by the movement of the plug 81 upwardly and the flow of refrigerant to the motor housing as shown in FIG. 6, then the force of gravity acts as a bias to move the plug 81 back to the minimum flow position in preparation for the next start up.

Figure 7:
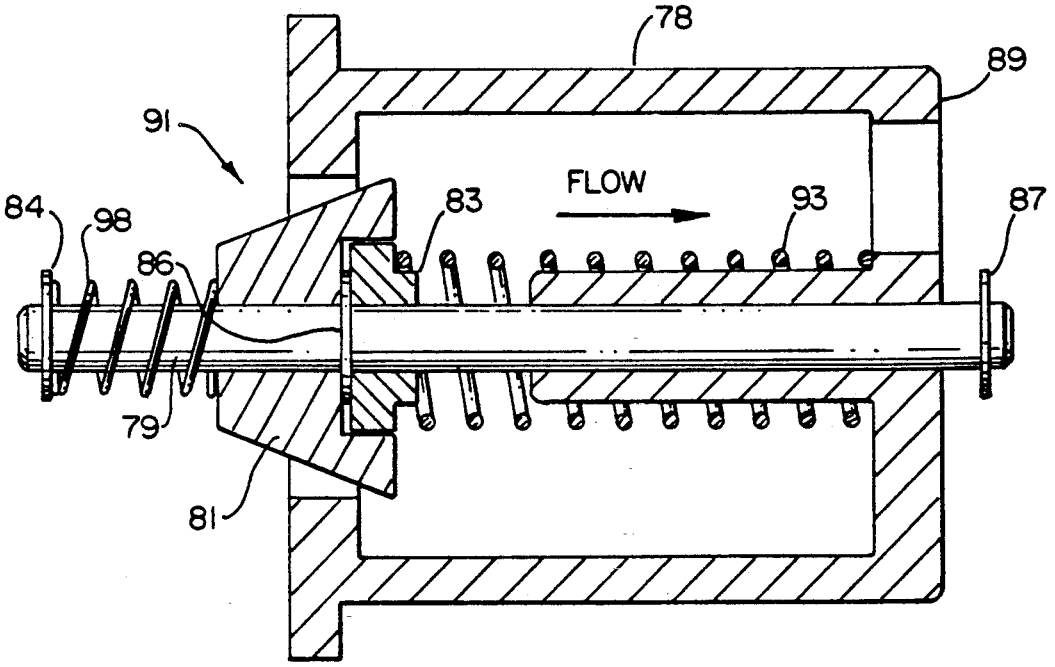
FIG. 7 is a longitudinal sectional view of a modified embodiment of the invention with the valve in a horizontal position, showing the refrigerant flow during normal operating conditions.
Figure 8:
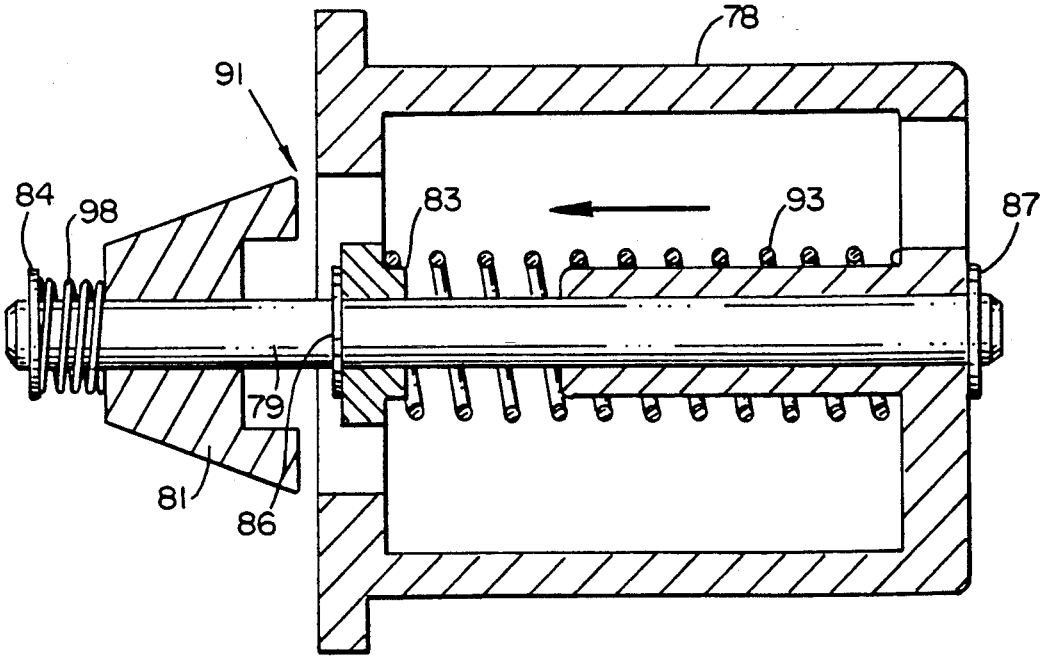
FIG. 8 is a longitudinal sectional view of a modified embodiment of the invention with the valve in a horizontal position, showing the refrigerant flow during shut-down conditions.

The modification of the valve as shown in FIGS. 7 and 8, will allow the valve to be mounted in any orientation between vertical and horizontal layouts since the valve is no longer dependent on gravity to provide the bias following pressure equalization upon shut down. A spring 98 is added between the piston 81 and the retaining ring 84 to provide this function. The spring 98 is of low stiffness such that it will not require a substantial negative pressure differential to move the tapered plug 81 towards the retaining ring 84. Also the free length of the spring is selected such that it is equal to the length between the retaining ring 84 and the retaining ring 86. This will ensure that the tapered ring 81 is not pushed beyond the position of minimum area when there is no pressure differential between the motor and the cooler.

The operation of the valve is identical to that for the valve of FIGS. 5 and 6 as described above except that the plug 81 is biased by the spring 98 from moving against the retainer ring 84 as shown in FIG. 8. However, when the reverse flow condition is present upon shut down, the inlet opening 91 will still be sufficient to allow the relatively unrestricted flow of refrigerant into the motor casing 16. The spring will then act to move the plug 81 back to the minimum flow position following pressure equalization.

Figure 10:
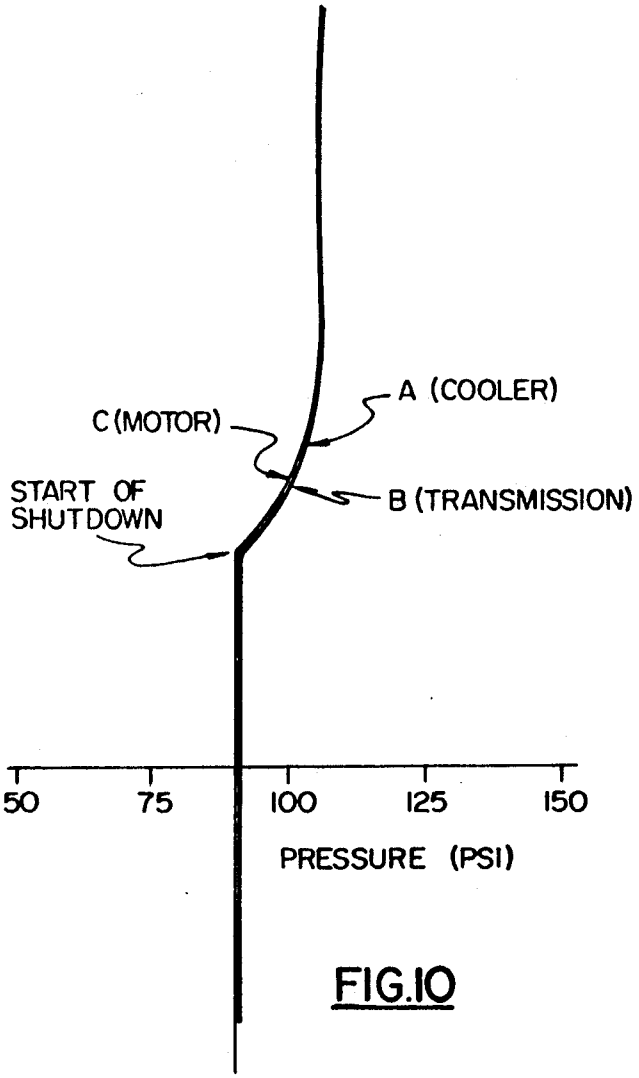
FIG. 10 is a graphic illustration of the various pressures during shut-down conditions of a compressor having a back-pressure valve with a reverse flow feature.
Figure 9:
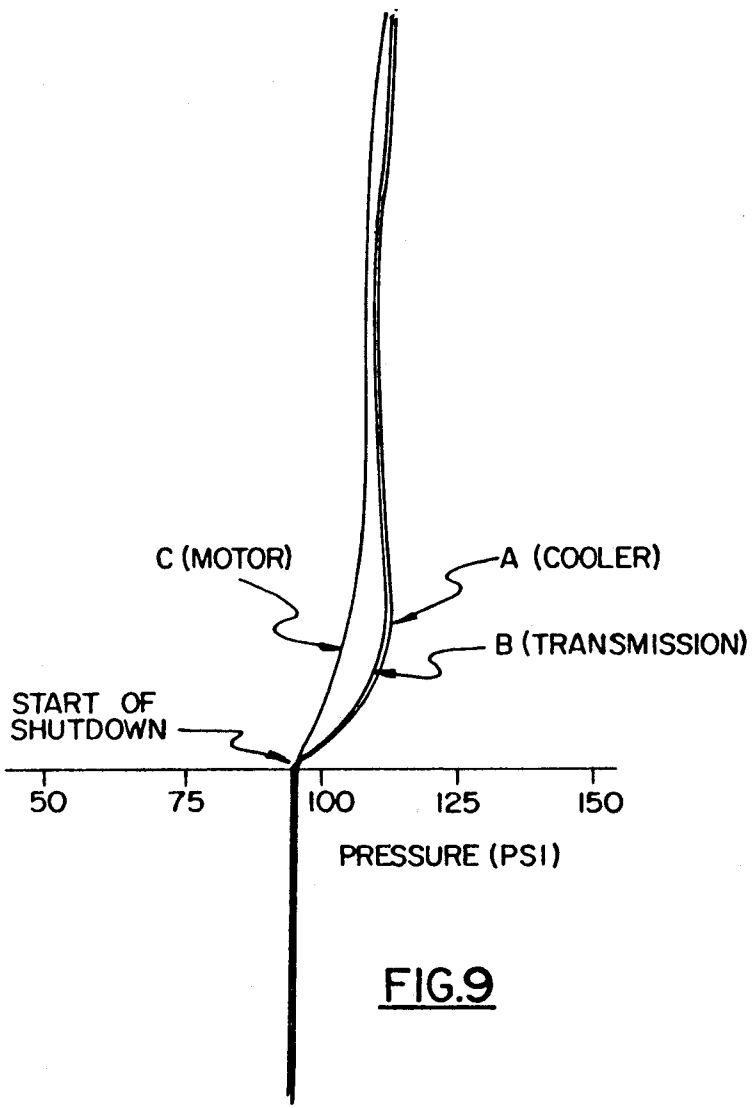
FIG. 9 is a graphic illustration of the various pressures during shut-down conditions of a compressor having a back-pressure valve with no reverse flow feature.

Referring now to FIGS. 9 and 10, the respective pressures in the cooler, the transmission and the motor are plotted as a function of time, with the chart being plotted at a speed of 12,000 mm per hour. In the test presented by the graph of FIG. 9, the system had a back-pressure valve with a relatively short shaft 79 such that the retainer ring 84 was in abutting relationship with the plug other end 97 to restrict any substantial flow of refrigerant in the reverse direction. As will be seen in FIG. 9, the pressure in the cooler (curve A) quickly rises to a level of about 115 psi, and that in the transmission (curve B) follows very closely thereto, whereas the pressure in the motor casing, as indicated by the curve C, tends to rise at a much more gradual rate such that a substantial differential exists. This pressure differential will cause the loss of oil as described hereinabove.

With the back-pressure valve 46 designed as described hereinabove, i.e. with the tapered plug having the freedom to move outside of the inlet opening 91 to permit a reverse flow of refrigerant as shown in FIGS. 6 and 8, the resulting pressures will occur as shown in the test data of FIG. 10. Here, the increase in pressure within the motor casing very closely approximates the increase in pressure of both the cooler and the transmission. As a result, the pressure differential between the motor casing and the transmission is minimal, and the loss of oil from the system is also minimized.

Once the pressure in the motor is equal to that in the cooler, gravity or spring force, depending on the construction of the valve, will force the piston to a minimum area position. If the piston is not so returned to the minimum area position, then at subsequent machine start, the cooler and motor pressure will be equal, resulting in oil loss from the transmission into the motor housing.

Although the present invention has been shown and described with respect to preferred and modified embodiments, it will be understood by those skilled in the art that various changes in the form and detail thereof may be made without departing from the true spirit and scope of the claimed invention.

What is claimed is:

1. An improved back-pressure valve for a centrifugal compressor of the type driven by an electric motor which is cooled by refrigerant passing through a motor casing and out to a cooler by way of the valve, wherein the improvement comprises;

a valve body having an inlet opening formed in one end thereof for receiving a flow of refrigerant from the motor casing and allowing it to pass through said body and out a discharge end to the cooler;

a shaft mounted in said body in alignment with the general direction of refrigerant flow;

a piston mounted on said shaft so as to be positionable between a minimum flow position near the inlet opening upon compressor start-up and a maximum flow position nearer said discharge end when the compressor reaches maximum speed; and a first biasing means for biasing said piston toward said minimum flow position.

2. An improved back-pressure valve as set forth in claim 1 wherein said piston has an outer diameter that is tapered with the diameter increasing towards said body discharge end.

3. An improved back-pressure valve as set forth in claim 1 wherein said shaft is mounted in said body discharge end.

4. An improved back-pressure valve as set forth in claim 1 wherein said first biasing means is a spring mounted on said shaft.

5. An improved back-pressure valve as set forth in claim 1 and including a second biasing means for biasing said piston toward said discharge end, and further wherein said shaft extends and projects through said inlet opening such that under conditions of reverse refrigerant flow, said piston is moveable to a position entirely outside of said valve body to thereby allow relatively unobstructed flow of refrigerant into the motor casing until the refrigerant pressures in the motor casing and the cooler are substantially equalized, after which said second biasing means functions to move said piston to said minimum flow position.

6. An improved back-pressure valve as set forth in claim 5 and including a retainer element attached to said shaft near the inlet opening to restrict said first biasing means from biasing said piston to a position outside said inlet opening.

7. An improved back-pressure valve as set forth in claim 6 wherein said piston has a cavity formed on its side nearest said discharge and, further wherein said retainer element fits into said cavity when said piston engages said retainer element.

8. An improved back-pressure valve as set forth in claim 6 wherein said retainer element is secured to said shaft by a retaining ring engaging the side of the retainer element opposite said first biasing means.

9. An improved back-pressure valve as set forth in claim 5 and including a retainer ring attached near an extended end of said shaft to thereby limit the movement of said piston under conditions of reverse refrigerant flow.

10. An improved back-pressure valve as set forth in claim 1 and including a retainer ring secured near one end of said shaft and engageable with an outer surface of said valve body discharge end.

11. A method of operating a centrifugal compressor of the type having an electric motor which is cooled by refrigerant passing through a motor casing and out a return line, comprising of the steps of;

providing a pressure responsive valve in the return line such that the flow of refrigerant from the motor casing to the return line is automatically regulated in such a manner as to maintain a predetermined pressure drop across said valve during normal operation of the centrifugal compressor; and when the compressor is shut down, providing for the relatively unrestricted flow of refrigerant gas from the return line, through the valve, and into the motor casing.

12. A method as set forth in claim 11 wherein said unrestricted flow is provided by allowing a piston to move outside a body of said valve when the refrigerant flows into the motor casing.

13. An improved back pressure valve as set forth in claim 5 wherein said second biasing means comprises the force of gravity.

14. An improved back pressure valve as set forth in claim 5 wherein said second biasing means comprises a second compression spring disposed on the opposite side of said plug from said first compression spring.

* * * * *